US008702459B2

(12) United States Patent
Flockenhagen

(10) Patent No.: US 8,702,459 B2
(45) Date of Patent: Apr. 22, 2014

(54) FLOATING TECHNICAL HOLLOW BODY AND METHOD OF MANUFACTURE

(75) Inventor: Gerhold Flockenhagen, Weener-Kirchborgum (DE)

(73) Assignee: Weener Plastik GmbH, Weener (DE)

( * ) Notice: Subject to any disclaimer, the term of this patent is extended or adjusted under 35 U.S.C. 154(b) by 103 days.

(21) Appl. No.: 13/018,769

(22) Filed: Feb. 1, 2011

(65) Prior Publication Data

US 2012/0024215 A1 Feb. 2, 2012

Related U.S. Application Data

(60) Provisional application No. 61/300,680, filed on Feb. 2, 2010.

(51) Int. Cl.
*B63B 22/00* (2006.01)

(52) U.S. Cl.
USPC ..... 441/1

(58) Field of Classification Search
USPC ..... 114/256; 441/1, 6, 28, 30, 32, 133
See application file for complete search history.

(56) References Cited

U.S. PATENT DOCUMENTS

| | | | | |
|---|---|---|---|---|
| 2,350,883 | A * | 6/1944 | Duttweiler | 62/64 |
| 3,955,524 | A * | 5/1976 | Renoux | 114/74 T |
| 5,188,550 | A * | 2/1993 | Oliver | 441/1 |
| 5,415,577 | A * | 5/1995 | Burns | 441/6 |
| 5,658,178 | A * | 8/1997 | Varga | 441/1 |
| 6,860,218 | B2 * | 3/2005 | Eagles et al. | 114/256 |
| 7,500,442 | B1 * | 3/2009 | Schanz | 114/256 |
| 2009/0211010 | A1 * | 8/2009 | Alac | 4/498 |

* cited by examiner

*Primary Examiner* — Stephan Avila
(74) *Attorney, Agent, or Firm* — Hamilton Brook, Smith & Reynolds, P.C.

(57) ABSTRACT

A floating technical hollow body (1), in particular for covering open liquid areas, comprises a shell, which is formed by at least two interconnected shell parts (1A, 1B), which at least comprises one opening (2.2) for filling the shell interior with liquid, and in which at least a fluid-in particular an air-tight inner hollow body (4; 4') is arranged.

22 Claims, 7 Drawing Sheets

FLOATING TECHNICAL HOLLOW BODY AND METHOD OF MANUFACTURE

RELATED APPLICATION

Figure 1:
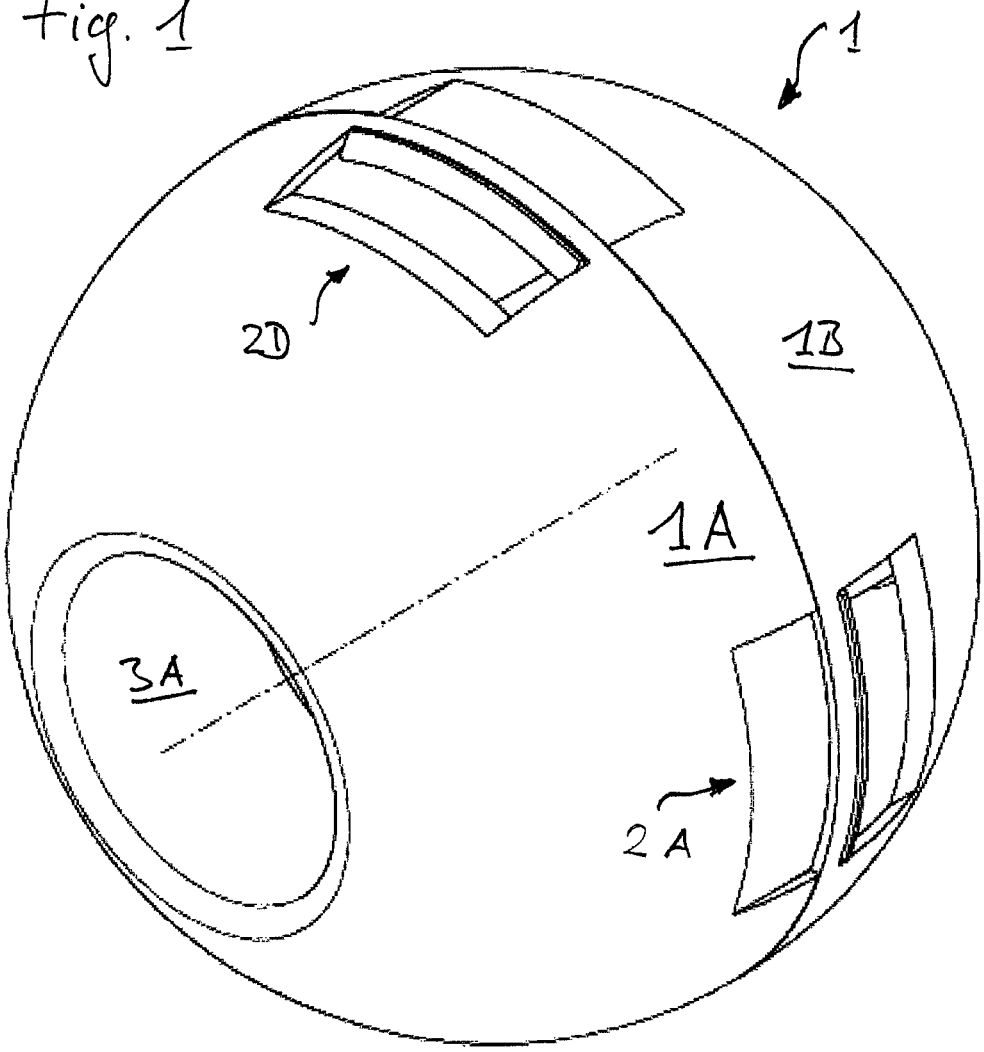

This application claims the benefit of U.S. Provisional Application No. 61/300,680, filed on Feb. 2, 2010. The entire teachings of the above application are incorporated herein by reference.

DESCRIPTION

The present invention relates to a floating technical hollow body, in particular for covering open water areas to birds, according to claim 1, as well as to a method of manufacture.

In particular in the vicinity of airports so-called artificial static water supplies are provided to be able to rapidly supply large amounts of water in case of fire. Hereby, there is a risk that birds swim or nest on such open water areas. This can not only lead to a pollution of the fire water, but also in the case of a fire to a sucking in of the birds by the extinguishing pumps. In addition, nesting of birds near an airport is generally undesirable, because of the risk of bird strikes.

Therefore, it is popular to substantially completely cover such artificial static water supplies with floating technical hollow bodies, which camouflage the water surface to the birds and which complicate or prevent their landing and resting on the water surface. Such an arrangement of floating technical hollow bodies can also be used for other open liquid area, for example, as for the protection or the isolation of swimming pools, clarifiers, open tanks, and the like.

For this purpose, until now, hollow balls, made of plastic, are manufactured according to in-house practice. Subsequently, a drill hole is made to the inside of the ball, through which the inside of the hollow body is filled with a predetermined amount of drinking water for example, to one to two third, and the drill hole is then again sealed by a plug.

This requires high production costs, not only because of the number of the individual manufacturing steps, but also due to the already during the production process filled-in drinking water, which disadvantageously generates a high transport weight of the balls.

The object of the present invention is, to provide an improved floating technical hollow body.

This object is achieved by a hollow body with the characteristics of claim 1 or a manufacturing method having the characteristics of claim 11. Preferred embodiments are the subject-matter of the dependent claims.

A floating technical hollow body of the invention, can for example, be used for covering open liquid areas, in particular, water areas against birds.

It comprises a hollow shell, that is formed by two or more interconnected shell parts. The shell comprises one or more, preferably at least substantially equidistantly distributed openings for filling up the interior of the shell with liquid, especially with water. In the interior of the shell, one or more fluid-, especially air-tight inner hollow bodies are arranged.

Due to the opening(s) in the shell and due to one or several inner hollow bodies, a hollow body according to the invention can advantageously be prefabricated non-filled and transported.

Due to the opening(s) it can then take up in a self-filling manner liquid in particular, on site, by placing it on the open liquid area, whereby the required buoyancy is achieved by the one or several inner hollow bodies. In addition, the manufacturing cost can be advantageously reduced, in particular when the opening(s) are in a preferred embodiment, pre-molded with one or more shell part(s).

To further reduce the production cost, in a preferred embodiment, two or more and in particular, all interconnected shell parts are identically, or substantially identically formed. This may in particular enable, to pre- or re-mold two or more shell parts with the same tool.

Shell parts can be detachably or permanently joined. They can for example, be joined by material adhesion, for instance by gluing or sealing, be joined by form-fitting, for instance by catch projections and notches, or openings that engage one another, and/or joined by force, in particular, by friction, for instance by press-fitting or the like. In a preferred embodiment, two shell parts are joined by means of one or several catch projection(s), which then are preferably equidistantly distributed over a circumference of the shell parts.

In particular, when a continuous notch, in which a catch projection of a snap-in connection engages, is formed correspondingly larger, a snap-in connection can at the same time form an opening for filling the shell interior with liquid.

If an inner hollow body is formed separately, it can be, prior to connecting the shell parts together, introduced into them, for example, by inserting. Preferably, it is attached to the shell in such it can only perform limited, preferably small, relative movements, or it is at least substantially rigidly fixed to the shell. Herefor, one or more, preferably at least substantially hollow cylindrical shaped projections can be formed on the inside of the shell and/or on the outside of the inner hollow body, whereby such a projection is in a preferred embodiment formed integral with the shell, or with the inner hollow body, in particular formed by pre-molding.

In a preferred embodiment, an inner body is defined one or more sided, by two, three, or more projections, which are distant from each other, whereby interspaces between the projections, which are distant from each other can allow a flow through and/or a deformation of the projections, to compensate for example, different thermal expansions of the shell, the inner hollow body and/or filled-in liquid, in particular to ease the pressure of formed ice when the filled-in liquid freezes.

Additionally or alternatively, an inner hollow body can be formed integrally with the shell. In particular, two or more interconnected shell parts can comprise correspondingly, for example, inside hollow cylindrical projections, which when the shell parts are interconnected, define together the inner hollow body. These projections can, as the shell parts, be joined detachably or permanently. They can therefore, for example be, joined by material adhesion, for instance by gluing, or sealing, be joined by form-fitting, for instance by catch projections and notches or openings that engage one another, and or joined by force, in particular, by friction, for instance by press-fitting or the like. It may be advantageous, to provide a sealant and/or an adhesive between the projections, that form an inner hollow body.

Preferably, the shell and/or the one or several inner hollow bodies are spherical or substantially spherical, i.e. with a form of a hollow ball. Such a ball symmetrical design contributes to an optimal orientation-free covering of the liquid area. Equally, however, other preferably, rotationally symmetric, shells and inner hollow body forms are possible, such as cylindrical, conical, or rectangular forms.

In a preferred embodiment, the shell and/or one or more inner hollow bodies are made of a plastic, especially polyethylene (PE). The shell preferably, has a maximum external dimension, for example a ball diameter, of between 3 cm and 15 cm preferably, of between 5 cm and 10 cm.

Advantageously, the one or several inner hollow bodies, arranged within the shell interior, and the shell, are in terms of their size, wall thickness, and material, as well as the fluid, preferably air, which is enclosed in the one or several inner hollow bodies, are adjusted in such that the uplift of the hollow body, floating on an open liquid area occurs within a predetermined range. This range is preferably selected such, that on one side the blowing away of the hollow body by wind or the like, is prevented or made difficult by the weight force of the hollow body and the uptaken liquid inside, and on the other side, that it can resist to birds or other objects, that are supposed to be kept off.

Shell parts can advantageously be manufactured by pre-molding, in particular by stretch or injection blow molding, extruding or injection molding. Two or more shell parts can preferably, become interconnected on site, directly before placing them on the liquid area, for example, by locking the parts permanently to each other.

In a preferred embodiment, a hollow body comprises one or more, preferably individual, in pairs or in groups equidistantly distributed stiffeners. These can be arranged on the inside and/or on the outside of the shell and/or on the projections in particular, integrally, for example, by pre-molding, to define an inner hollow body. Preferably, stiffeners of a shell part are extending beyond the contact boundary into the area of an adjacent shell part, and get in case of composite shell parts, support from the adjacent shell part, to thereby reinforce the connection of the shell parts.

Figure 2:
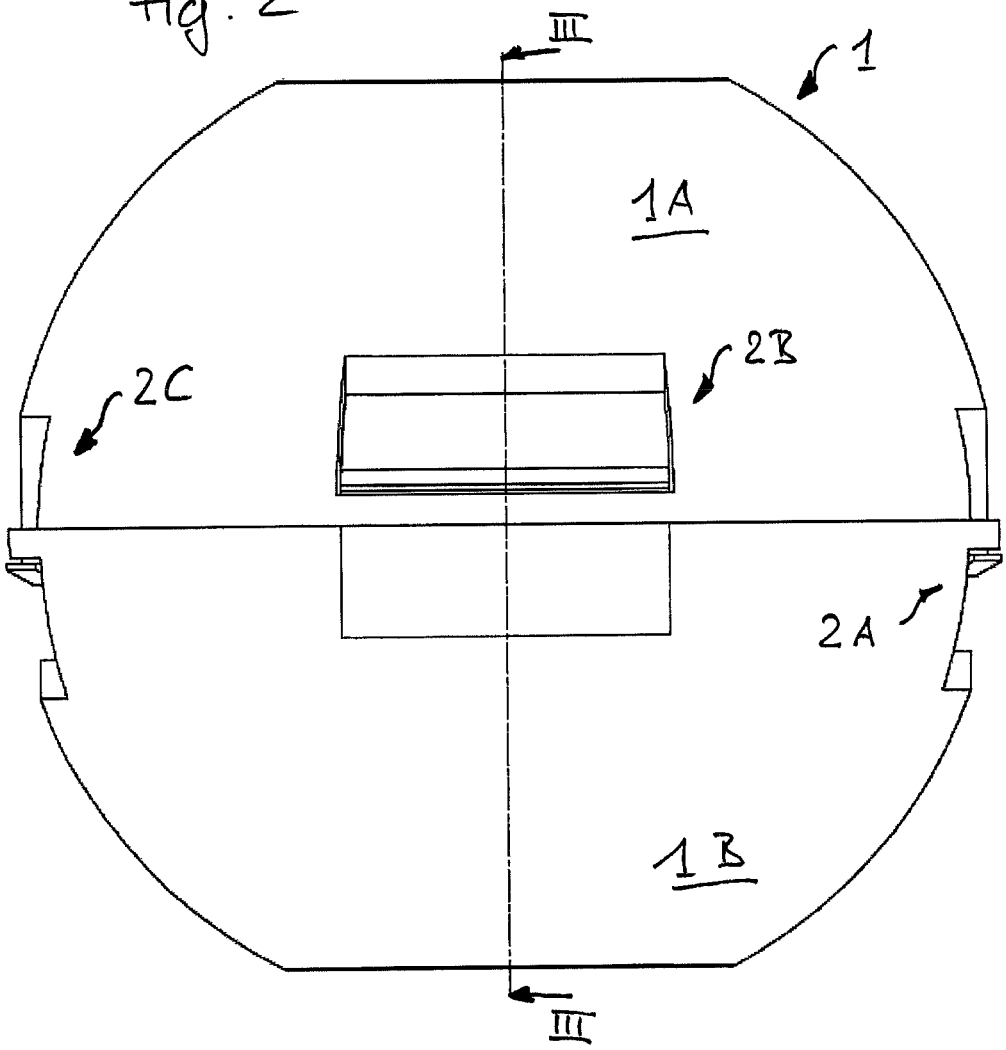
Figure 3:
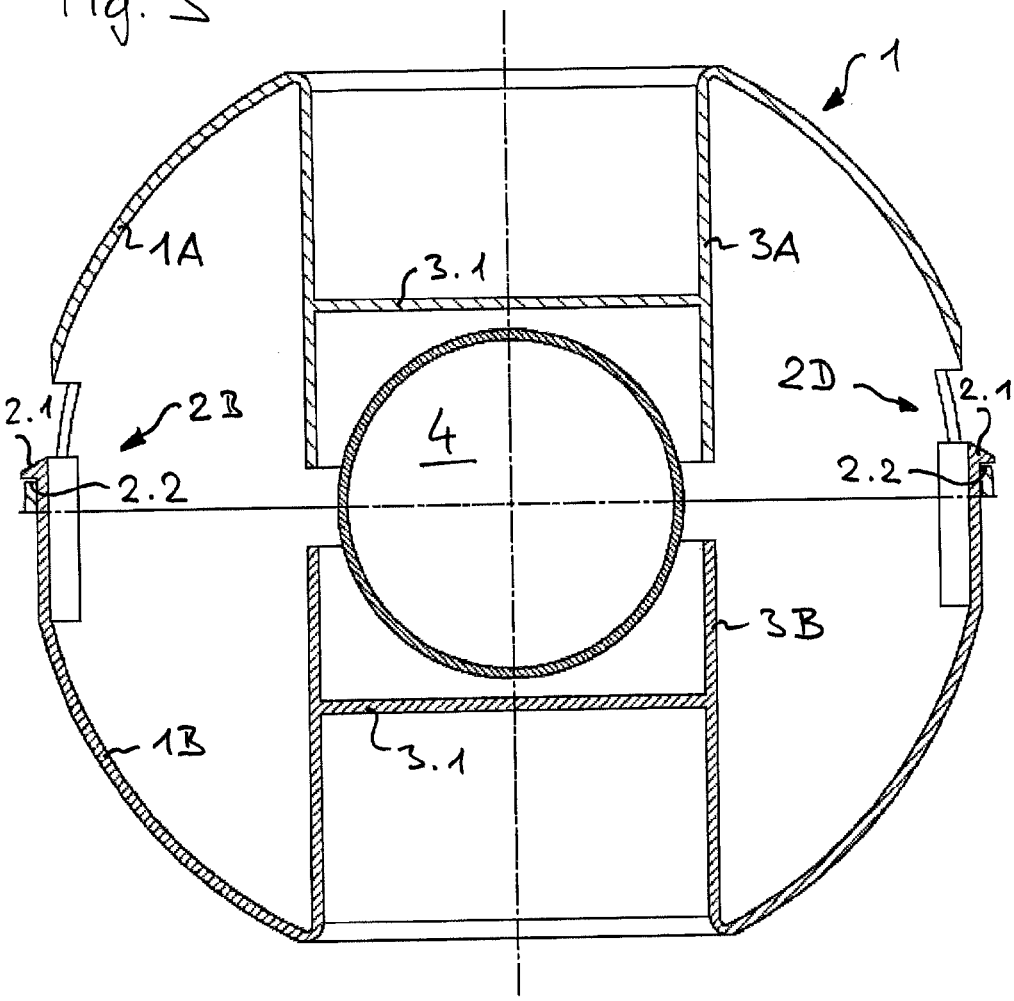
Figure 4:
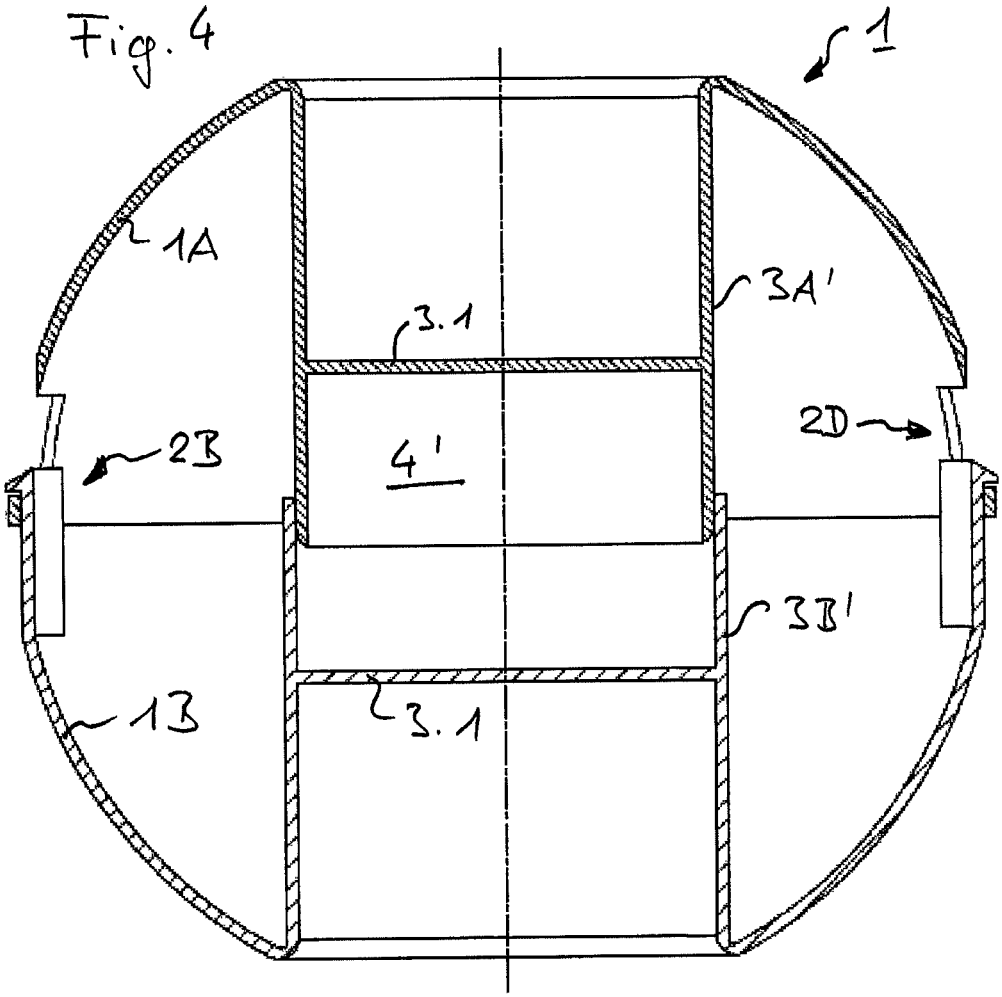
Figure 5:
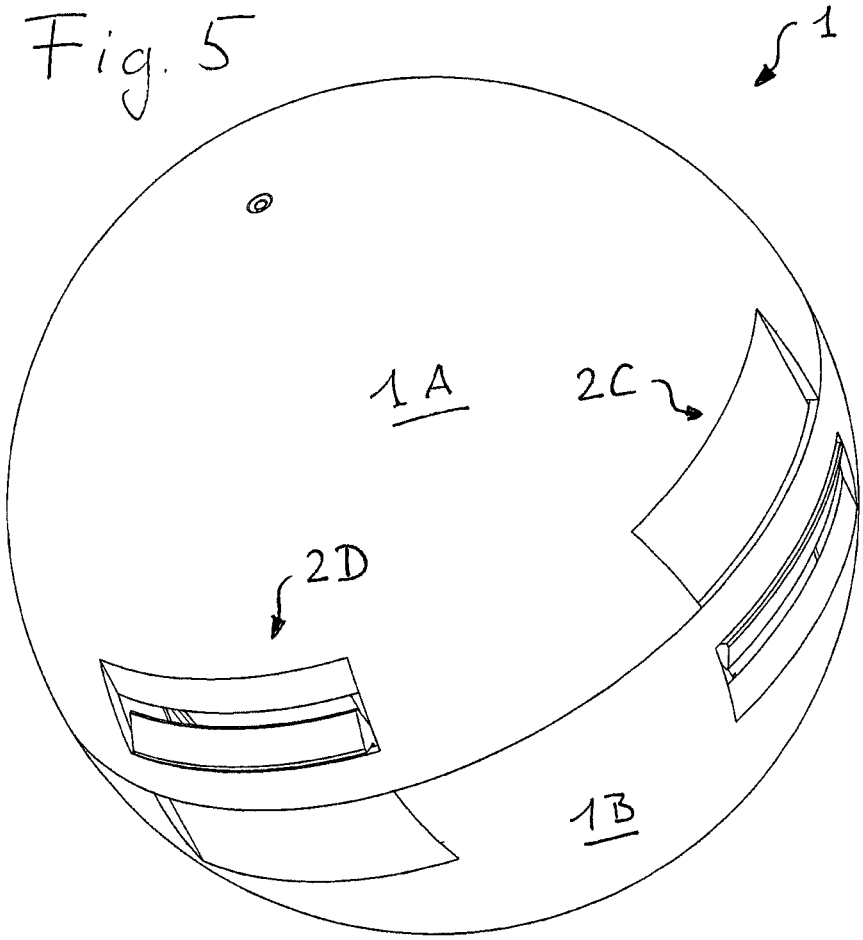
Figure 6:
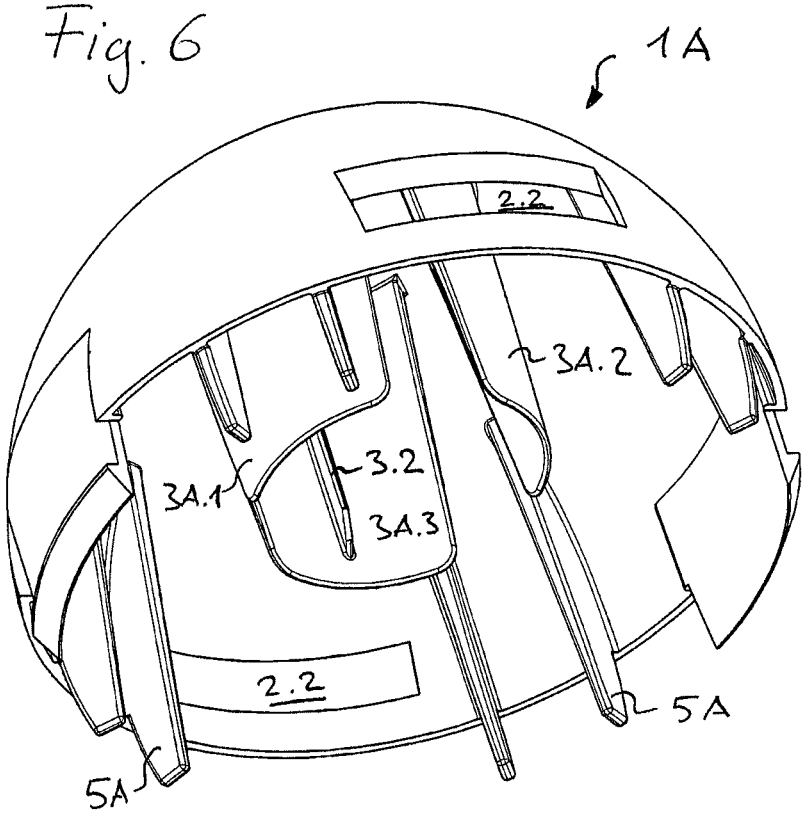
Figure 7:
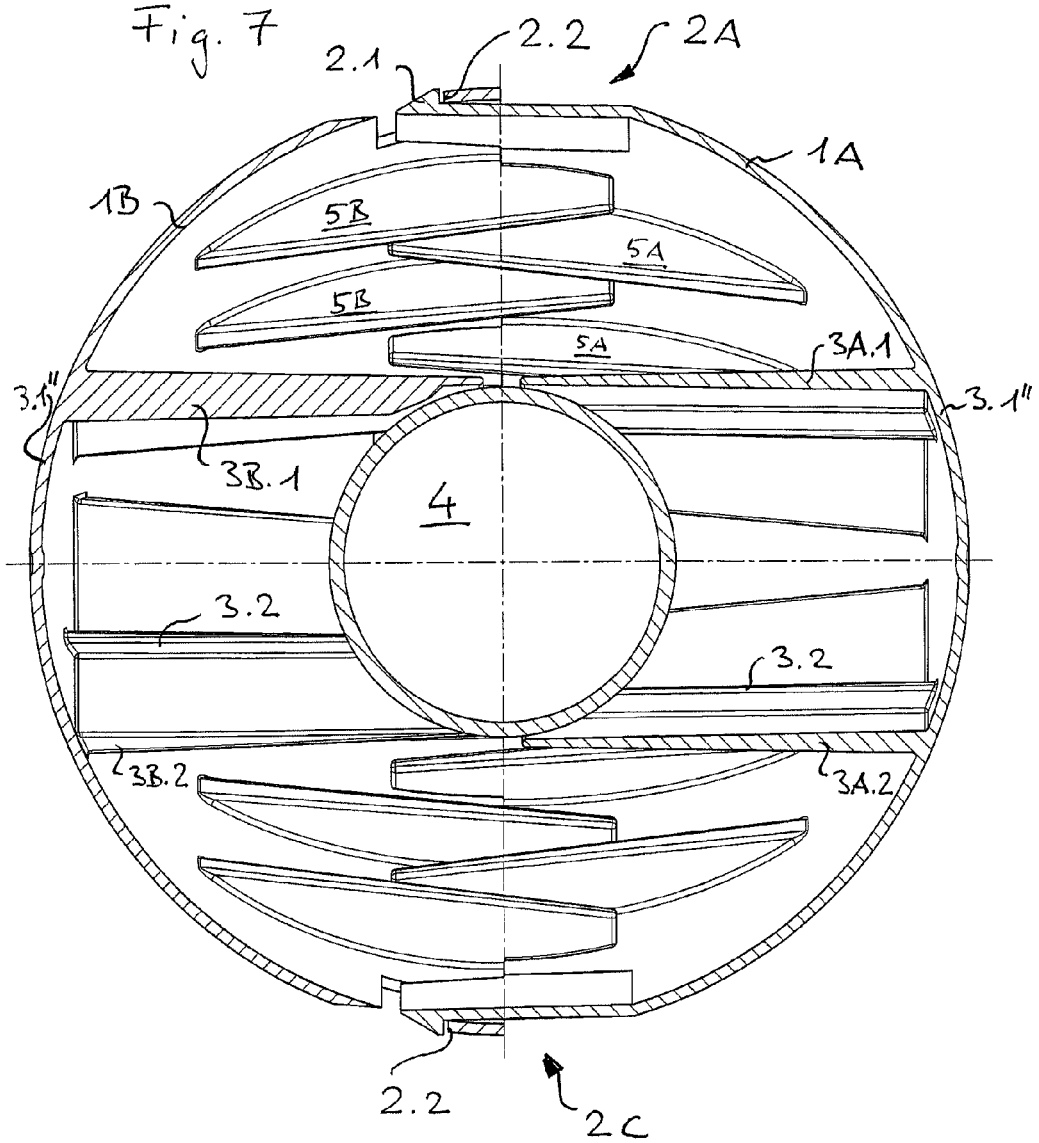

Additional advantages and characteristics emerge from the dependent claims and embodiments. This is shown, partially schematically in:

FIG. 1: a floating technical hollow ball according a first embodiment of the present invention in perspective view;

FIG. 2: a plan view of the hollow ball of FIG. 1;

FIG. 3: a section along the line in FIG. 2;

FIG. 4: a floating technical hollow ball according to a second embodiment of the present invention in corresponding representation of FIG. 3;

FIG. 5: a floating technical hollow ball according to a third embodiment of the present invention in corresponding representation of FIG. 1;

FIG. 6: a shell part of the hollow ball according to FIG. 5 in perspective view; and FIG. 7: a cross section of the hollow ball according to FIG. 5.

The FIGS. 1 to 3 show a floating technical hollow ball (1) according to a first embodiment of the present invention.

It is assembled of two shell parts (1A, 1B), which are by four equidistantly spaced snap-in connections (2A) to (2D), which are shifted by a degree of 90°, permanently connected with each other, i.e. only removable by material destruction. Each snap-in connection is formed by a catch projection (2.1), which engages by form or force with a corresponding notch or opening (2.2) of an opposing shell part.

On the inside of the shell parts (1A, 1B), which are produced of PE by injection molding, hollow cylindrical projections (3A or 3B) are formed, which inner side of the each other facing front side, are not contacting each other.

Between the projections (3A, 3B) of the interlocked shell parts (1A, 1B), a separate, inner hollow ball (4), which is for example, formed by extrusion blow molding, is freely arranged with backlash, which, is inserted in a projection (3A or 3B) interconnecting the shell parts (1A, 1B). The inner diameters of the projections (3A, 3B) are correspondingly selected slightly larger than the outside diameters of the inner hollow ball (4) and additionally, closed in appropriate height by an inner wall (3.1).

The inner hollow ball (4) is formed air-tight and in its interior filled with air. The notches (2.2) are formed so big, that also when the snap-in connection is closed an opening to the inside of the body remains, through which water can enter and air can escape.

The ball 1 is formed by joining the shell parts (1A, 1B), which have an inner hollow ball (4), before transporting it to an artificial static water supply of an airport or on site. Subsequently, the ball (1) is placed on the water surface of the artificial static water supply (not shown). Through the openings (2.2) it is self-filled with water. Thereby, the diameter of the inner hollow ball (4) is adjusted in such to the ball and to the weight of the shell parts (1A, 1B) and to the water uptaken in the latter, so that the ball (1) has a buoyancy, which opposes to landing birds sufficient resistance, but on the other hand, is so low that the ball (1) will not be blown out of the water pond by normal winds.

It can be seen in particular, in the cross-section of FIG. 3, the identical design of the two shell parts (1A, 1B), which each comprise two opposing catch projections (2.1) and two mutually opposing notches or openings (2.2), so that they are turned 90°, relative to each other, and can be locked together. This allows to produce both shell parts (1A, 1B) at low cost with the same tool.

FIG. 4 shows a corresponding representation of FIG. 3, a floating technical hollow ball according to a second embodiment of the present invention. Matching features to the first embodiment, are numbered with identical reference numerals of so that only the differences to the otherwise conform first embodiment are mentioned in the following.

For the second embodiment, instead of the separately formed inner hollow ball (4) an inner cavity (4') is formed by the two hollow cylindrical shaped projections (3A', 3B), integrally with the shell parts (1A and 1B), which herefor are in its interior, each closed by an inner wall (3.1), and air-tightly overlap each other with their opposing front sides, so that upon joining the two shell parts (1A, 1B) the hollow cylindrical shaped inner cavity (4') is formed and air-tightly sealed.

For this purpose, one of the two projections (3A', 3B') can have on its front side an outer diameter, which with the inner diameter of the front side of the other two projections (3A', 3B'), has an appropriate fit, especially a press-fit. Additionally or alternatively, a sealant and/or an adhesive can be provided between the two projections (3A', 3B'), which can substitute, in a non-illustrated modification, the snap-in connections (2A to 2D).

Similarly, instead of different diameters, the mutually opposing front sides of the two projections (3A', 3B') can also be so flexibly formed in a also non-illustrated modification, so that they are connected air-tightly with each other, under elastic deformation, i.e. expansion of the one and compression of the other, which, allows, as with the first embodiment, the production of both shell parts with the same tool.

The inner diameter of the projections (3A', 3B') and the height at which the inner wall (3.1) is arranged, i.e. the internal volume of the inner cavity (4'), is again selected such that, the ball (1), which is self-filled with water, has the desired buoyancy, to resist equally to the landing of birds and to be blown away by wind.

FIG. 5 to 7 show a floating technical hollow ball according to a third embodiment of the present invention. The features that match with the first embodiment are again designated with identical reference numbers so that, in the following, only the differences are mentioned to the otherwise matching first embodiment.

It can be seen on one side in FIG. 6, 7, that both shell parts (1A, 1B) each comprise eight stiffeners on the inside (5A and 5B), which are produced integrally with the shell parts and which are in pairs equidistantly distributed over the contact boundary. They extend, as seen particularly in FIG. 6, in such over the contact boundary of each shell part (downward in FIG. 6), so that in case of a composite shell (see FIG. 7), they are form-fit supported on the inside of the other shell part, and increase thereby the form stability of the shell and the strength of the shell part connection.

Contrary to the first embodiment, the inner body (4) of the third embodiment is fixed with play on both sides with each three projections (3A.1, 3A.2 and 3A.3 or 3B.1, 3B.2), which are distant from each other by interspace. The longitudinal slots of the interspace between the protrusions, which are distant from each other, enables an elastic spreading of the protrusions, to compensate for different thermal expansions of the shell, the inner hollow body, and filled-in liquid, and eases a flow through.

To strengthen, the projections 3A.1, . . . , 3B.2 comprise each on the inside a stiffener (3.2), which end slanted, below the area, which defines the inner hollow body (4) and so visibly, as seen particularly in FIG. 6, fixes the inner hollow body (4) in the longitudinal direction of the projections with play.

Contrary to the first embodiment, the inner wall (3.1") is formed as part of the, substantially closed, except for the openings (2.2), spherical outer contour of the hollow ball (1), as particularly seen in FIG. 1, 5. A cast of the shell parts (1A, 1B), pre-molded by plastic injection molding is seen in FIG. 5,7.

The invention claimed is:

1. Floating hollow body for covering open liquid areas, comprising:

a shell composed of at least two interconnected, identical shell parts joined together to form the shell;

at least one opening in the shell, the at least one opening being defined by a snap-in connection between the shell parts and being configured such that due to the at least one opening the floating hollow body takes up, in a self-filling manner, liquid into the interior of the shell when it is placed on an open liquid; and at least one fluid-tight inner hollow body arranged in the interior of the shell;

wherein the at least one fluid-tight inner hollow body is secured to the shell by at least one projection on the inside of the shell and/or at least one projection on the outside of the at least one fluid-tight inner hollow body.

2. The hollow body according to claim 1, wherein the at least one fluid-tight inner hollow body is integral with the shell.

3. The hollow body according to claim 1, wherein the shell and/or the at least one fluid-tight inner hollow body are at least substantially spherical.

4. The hollow body according to claim 1, wherein the shell and/or the at least one fluid-tight inner hollow body is made of polyethylene.

5. The hollow body according to claim 1, wherein the at least one fluid-tight inner hollow body, arranged in the interior of the shell, and the shell, are adjusted to each other such, that the hollow body, floating on an open liquid area, has a predetermined buoyancy.

6. The hollow body according to claim 1, further comprising at least one stiffener to reinforce the shell.

7. Process for manufacturing a floating hollow body for covering open liquid areas, the hollow body comprising:

a shell composed of at least two interconnected, shell parts joined together to form the shell;

at least one opening in the shell, the at least one opening being defined by a snap-in connection between the shell parts and being configured such that due to the at least one opening the floating hollow body takes up, in a self-filling manner, liquid into the interior of the shell when it is placed on an open liquid; and at least one fluid-tight inner hollow body arranged in the interior of the shell;

the process comprising the steps:

manufacturing the shell parts by pre-molding;

connecting the shell parts together;

whereby at least one opening is provided in the shell, the at least one opening being defined by a snap-in connection and being configured such that due to the at least one opening the floating hollow body takes up, in a self-filling manner, liquid into the interior of the shell when it is placed on an open liquid; and whereby at least one fluid-tight inner hollow body, formed integral with the shell, is formed by interconnecting the shell parts with each other; and/or whereby at least one fluid-tight inner hollow body is placed into the shell interior, before interconnecting the shell parts with each other.

8. The hollow body according to claim 1, wherein the shell has a maximum external dimension of between 3 cm and 15 cm.

9. Floating hollow body for covering open liquid areas, comprising:

a shell composed of at least two interconnected shell parts joined together to form the shell;

at least one opening in the shell, the at least one opening being defined by a snap-in connection between the shell parts and being configured such that due to the at least one opening the floating hollow body takes up, in a self-filling manner, liquid into the interior of the shell when it is placed on an open liquid; and at least one fluid-tight inner hollow body arranged in the interior of the shell;

wherein the at least one fluid-tight inner hollow body is integral with the shell and secured to the shell by at least one projection on the inside of the shell and/or at least one projection on the outside of the at least one fluid-tight inner hollow body.

10. The hollow body according to claim 9, wherein the shell and/or the at least one fluid-tight inner hollow body are at least substantially spherical.

11. The hollow body according to claim 9, wherein the shell and/or the at least one fluid-tight inner hollow body is made of polyethylene.

12. The hollow body according to claim 9, wherein the at least one fluid-tight inner hollow body, arranged in the interior of the shell, and the shell, are adjusted to each other such, that the hollow body, floating on an open liquid area, has a predetermined buoyancy.

13. The hollow body according to claim 9, further comprising at least one stiffener to reinforce the shell.

14. The hollow body according to claim 9, wherein the shell has a maximum external dimension of between 3 cm and 15 cm.

15. Floating hollow body for covering open liquid areas, comprising:

a shell composed of at least two interconnected shell parts joined together to form the shell;

at least one opening in the shell, the at least one opening being defined by a snap-in connection between the shell parts and being configured such that due to the at least one opening the floating hollow body takes up, in a self-filling manner, liquid into the interior of the shell when it is placed on an open liquid; and at least one fluid-tight inner hollow body arranged in the interior of the shell;

wherein the at least one fluid-tight inner hollow body is secured to the shell by at least one projection on the inside of the shell and/or at least one projection on the outside of the at least one fluid-tight inner hollow body; and wherein the shell and/or the at least one fluid-tight inner hollow body are at least substantially spherical.

16. The hollow body according to claim 15, wherein the shell and/or the at least one fluid-tight inner hollow body is made of polyethylene.

17. The hollow body according to claim 15, wherein the at least one fluid-tight inner hollow body, arranged in the interior of the shell, and the shell, are adjusted to each other such, that the hollow body, floating on an open liquid area, has a predetermined buoyancy.

18. The hollow body according to claim 15, further comprising at least one stiffener to reinforce the shell.

19. The hollow body according to claim 15, wherein the shell has a maximum external dimension of between 3 cm and 15 cm.

20. Floating hollow body for covering open liquid areas, comprising:

a shell composed of at least two interconnected, shell parts joined together to form the shell;

at least one opening in the shell, the at least one opening being defined by a snap-in connection between the shell parts and being configured such that due to the at least one opening the floating hollow body takes up, in a self-filling manner, liquid into the interior of the shell when it is placed on an open liquid; and at least one fluid-tight inner hollow body arranged in the interior of the shell;

wherein the fluid-tight inner hollow body is formed by hollow cylindrical projections formed on the inside of the shell parts, which projections together form an inner cavity integrally with the shell parts and are herefor each closed by an inner wall and air-tightly overlap each other with their opposing front sides, so that the inner hollow body in the form of the inner cavity is formed and air-tightly sealed.

21. Floating hollow body for covering open liquid areas, comprising:

a shell composed of at least two interconnected shell parts joined together to form the shell;

at least one opening in the shell, the at least one opening being defined by a snap-in connection between the shell parts and being configured such that due to the at least one opening the floating hollow body takes up, in a self-filling manner, liquid into the interior of the shell when it is placed on an open liquid; and at least one fluid-tight inner hollow body arranged in the interior of the shell;

wherein on the inside of the shell parts hollow cylindrical projections are formed, which inner side of the each other facing front side, are not contacting each other; and wherein the inner hollow body is a separate, inner hollow ball being freely arranged between said cylindrical projections, the inner diameter of which is selected slightly larger than the outside diameters of the inner hollow ball and which are additionally closed in appropriate height by an inner wall.

22. Floating hollow body for covering open liquid areas, comprising:

a shell composed of two interconnected, shell parts joined together to form the shell;

at least one opening in the shell, the at least one opening being defined by a snap-in connection between the shell parts and being configured such that due to the at least one opening the floating hollow body takes up, in a self-filling manner, liquid into the interior of the shell when it is placed on an open liquid; and a fluid-tight inner hollow body arranged in the interior of the shell;

wherein the shell parts each comprise stiffeners on the inside, which are produced integrally with the shell parts, and extend in such over the contact boundary of each shell part that in the composite shell the are form-fit supported on the inside of the other shell part; and wherein the shell parts each further comprise projections on the inside such that the inner body is fixed with play on both sides with each three projections, which are distant form each other by interspace.

* * * * *